US011377844B2

(12) United States Patent
Clifton

(10) Patent No.: US 11,377,844 B2
(45) Date of Patent: Jul. 5, 2022

(54) COLLAPSIBLE DWELLING

(71) Applicant: Matt James Clifton, East Brisbane (AU)

(72) Inventor: Matt James Clifton, East Brisbane (AU)

( * ) Notice: Subject to any disclaimer, the term of this patent is extended or adjusted under 35 U.S.C. 154(b) by 0 days.

(21) Appl. No.: 17/273,617

(22) PCT Filed: Sep. 5, 2019

(86) PCT No.: PCT/AU2019/000105
§ 371 (c)(1),
(2) Date: Mar. 4, 2021

(87) PCT Pub. No.: WO2020/047576
PCT Pub. Date: Mar. 12, 2020

(65) Prior Publication Data

US 2021/0317651 A1 Oct. 14, 2021

(30) Foreign Application Priority Data

Sep. 5, 2018 (AU) ..... 2018903301

(51) Int. Cl.
*E04B 1/344* (2006.01)
*E04B 1/343* (2006.01)
*E04H 1/12* (2006.01)

(52) U.S. Cl.
CPC ..... *E04B 1/3445* (2013.01); *E04B 1/34336* (2013.01); *E04B 1/34363* (2013.01);
(Continued)

(58) Field of Classification Search
CPC ..... E04B 1/3445; E04B 1/34336; E04B 1/34363; E04B 1/34384; E04B 2001/34389; E04H 1/1205
See application file for complete search history.

(56) References Cited

U.S. PATENT DOCUMENTS 2,473,076 A 6/1949 Scheibner
3,398,850 A * 8/1968 Henry ..... E04B 1/3445 220/6

(Continued)

FOREIGN PATENT DOCUMENTS

CA 2442403 3/2005
KR 100499801 7/2004

(Continued)

OTHER PUBLICATIONS

Baker, Keiligh, "Now your hotel can be almost as portable as your luggage! Dutch firm invents folding en-suite rooms—which can be packed up in just 10 Minutes," published on The Daily Mail.com, May 22, 2015, http://www.dailymail.co.uk/travel/travel_news/article-3093427/Dutch-firm-invents-folding-hotel-packed-10-minutes.html.

*Primary Examiner* — Gisele D Ford
(74) *Attorney, Agent, or Firm* — Ellenoff Grossman & Schole LLP; James M. Smedley; Alex Korona

(57) ABSTRACT

A collapsible dwelling includes a front wall assembly, a rear wall assembly, opposed sidewall assemblies, a roof assembly and a floor assembly. The wall assemblies are collapsible to be received between the floor assembly and the roof assembly, and at least one of the roof assembly and the floor assembly defines at least one recess, the, or each, recess being dimensioned to receive an appliance that is mounted on one of the wall assemblies when that wall assembly is in a collapsed configuration.

7 Claims, 17 Drawing Sheets

(52) U.S. Cl.
CPC ..... *E04B 1/34384* (2013.01); *E04H 1/1205* (2013.01); *E04B 2001/34389* (2013.01)

(56) References Cited

U.S. PATENT DOCUMENTS

| | | | | |
|---|---|---|---|---|
| 3,832,956 | A | 9/1974 | Briel, Jr. | |
| 3,849,952 | A * | 11/1974 | Hanaoka | E04B 1/34807 52/79.5 |
| 3,984,949 | A * | 10/1976 | Wahlquist | E04B 1/3445 52/70 |
| 4,074,475 | A * | 2/1978 | Wahlquist | E04B 1/3445 52/143 |
| 4,470,227 | A | 9/1984 | Bigelow, Jr. et al. | |
| 5,493,818 | A * | 2/1996 | Wilson | E04B 1/3445 52/71 |
| 8,763,315 | B2 * | 7/2014 | Hartman | E04B 1/34357 52/79.5 |
| 9,187,894 | B2 | 11/2015 | Zadok et al. | |
| 10,206,501 | B1 * | 2/2019 | Kindred, Jr. | A47B 43/04 |
| 2005/0126083 | A1 * | 6/2005 | Rebeck | E04H 1/1205 52/79.1 |
| 2006/0248809 | A1 * | 11/2006 | Rulquin | E04B 1/3445 52/79.5 |
| 2011/0290291 | A1 * | 12/2011 | Neal | E04H 1/1244 135/96 |
| 2012/0186166 | A1 * | 7/2012 | Casto | E04B 1/3445 52/79.5 |
| 2012/0317898 | A1 * | 12/2012 | Strachan | E04B 1/34869 52/79.5 |
| 2013/0074424 | A1 | 3/2013 | Trascher et al. | |
| 2013/0139449 | A1 * | 6/2013 | Ho | E04H 1/125 52/71 |
| 2017/0051497 | A1 | 2/2017 | Kolbe et al. | |
| 2017/0335561 | A1 * | 11/2017 | Wickramasekera | B60P 3/34 |

FOREIGN PATENT DOCUMENTS

| | | |
|---|---|---|
| WO | 2009126985 | 10/2009 |
| WO | 2015131238 A1 | 9/2015 |

* cited by examiner

COLLAPSIBLE DWELLING

FIELD OF THE INVENTION

This invention relates to a collapsible dwelling.

BACKGROUND OF THE INVENTION

Temporary housing structures, such as dwellings, find a multitude of uses. For example, they can be used in refugee situations, concerts, and in various other situations where it is necessary to house numbers of people in a temporary manner.

Presently available housing structures can be provided in a collapsible configuration, for storage and/or transportation.

Challenges for temporary housing structures, particularly for dwellings, is suitable structural integrity to protect occupants from the environment. Also, many temporary housing structures are simply not comfortable. For example, they may suffer from insufficient insulation and so may be uncomfortably warm or cold depending on the season. Furthermore, other temporary housing structures have components that are entirely separable from each other. This can make the storage and subsequent location of the various components logistically difficult.

SUMMARY OF THE INVENTION

According to an aspect of the invention, there is provided a collapsible dwelling that includes:

a front wall assembly;

a rear wall assembly;

opposed sidewall assemblies;

a roof assembly;

a floor assembly, wherein the wall assemblies are collapsible to be received between the floor assembly and the roof assembly; and at least one of the roof assembly and the floor assembly defines at least one recess, the, or each, recess being dimensioned to receive an appliance that is mounted on one of the wall assemblies when that wall assembly is in a collapsed configuration.

Thus, the collapsible dwelling provides a structure in which an appliance can be arranged so as not to require removal before the dwelling is collapsed. This allows the dwelling to be supplied or provided with the appliance, which is useful in applications where many the dwellings are required. It will be appreciated that a significant amount of time can be saved by simply erecting the dwelling without having subsequently to arrange or fit the appliance in the dwelling. This means that the collapsible dwelling can be erected without any significant level of skill required.

The wall assemblies may be dimensioned so that the dwelling is substantially rectangular when viewed from above. The wall assemblies may be configured to fold operatively inwardly with respect to the roof and floor assemblies so that the roof assembly can collapse downwardly towards the floor assembly.

The wall assemblies may be dimensioned so that the dwelling is elongate and rectangular with the sidewall assemblies defining major sides of the dwelling and the front and rear wall assemblies defining minor sides of the dwelling.

The front and rear wall assemblies may be configured to fold inwardly towards the floor assembly to overlie the floor assembly in general alignment with each other, at least one appliance being mounted on at least one respective front and rear wall assembly so that the, or each, appliance can be received in the, or each respective, recess when the front and rear wall assemblies are so folded inwardly.

The opposed sidewall assemblies are configured to collapse, inwardly, concertina-fashion, to overlie the front and rear wall assemblies when the dwelling is collapsed.

Each side wall assembly may include a lower panel and an upper panel. The lower panel may be hinged to the floor assembly at a lower edge and the upper panel may be hinged to the roof assembly at an upper edge. The lower and upper panels may be hinged to each other at respective upper and lower edges, so that the panels can fold inwardly to accommodate movement of the roof assembly towards the floor assembly when the dwelling is collapsed.

The, or each, recess may be defined by a receptacle arranged in the floor assembly. The, or each, receptacle may be configured to receive the, or each respective, appliance. The receptacle may be configured to protect the appliance from damage.

The front and rear wall assemblies may be mounted on the floor assembly with hinge assemblies that are configured to facilitate displacement of the, or each, appliance into the, or each respective, receptacle without interference.

The floor assembly may include a floor support structure and flooring arranged on the support structure. Each sidewall assembly may be pivotally connected, at a lower edge, to a respective side edge of the floor support structure. Lower hinge assemblies may be interposed between respective sidewall assemblies and associated side edges of the floor support structure to facilitate the pivotal connection. The roof assembly may include a roof support structure and roofing arranged on the roof support structure. Each sidewall assembly may be pivotally connected, at an upper edge, to a respective side edge of the roof support structure. Upper hinge assemblies may be interposed between respective sidewall assemblies and associated side edges of the roof support structure to facilitate the pivotal connection. Each sidewall assembly may include a longitudinally extending intermediate hinge assembly to allow the side assemblies to fold inwardly as the roof assembly is lowered towards the floor assembly.

The front and rear wall assemblies may be pivotally mounted to one of the floor support structure and roof support structure to pivot inwardly to accommodate the roof assembly being lowered towards the floor assembly. In one example, the front and rear wall assemblies may be pivotally mounted to respective front and rear edges of the floor support structure and may be detachable from the roof support structure.

The floor support structure may include a series of elongate structural elements, such as joists, that extend a length of the floor assembly to support the flooring. The joists may be spaced such that the flooring can be configured to allow the, or each, recess to be defined between consecutive joists. The, or each, receptacle can be positioned between consecutive joists.

According to a further aspect of the invention, there is provided a collapsible dwelling that includes:

a front wall assembly;

a rear wall assembly;

opposed sidewall assemblies;

a roof assembly;

a floor assembly; and at least one appliance mounted on at least one respective wall assembly;

wherein the wall assemblies are collapsible to be received between the floor assembly and at least one of the roof assembly and the floor assembly defines at least one recess, the, or each, recess being dimensioned to receive the, or each respective appliance that is mounted on one of the wall assemblies when that wall assembly is in a collapsed configuration.

DETAILED DESCRIPTION

Figure 1:
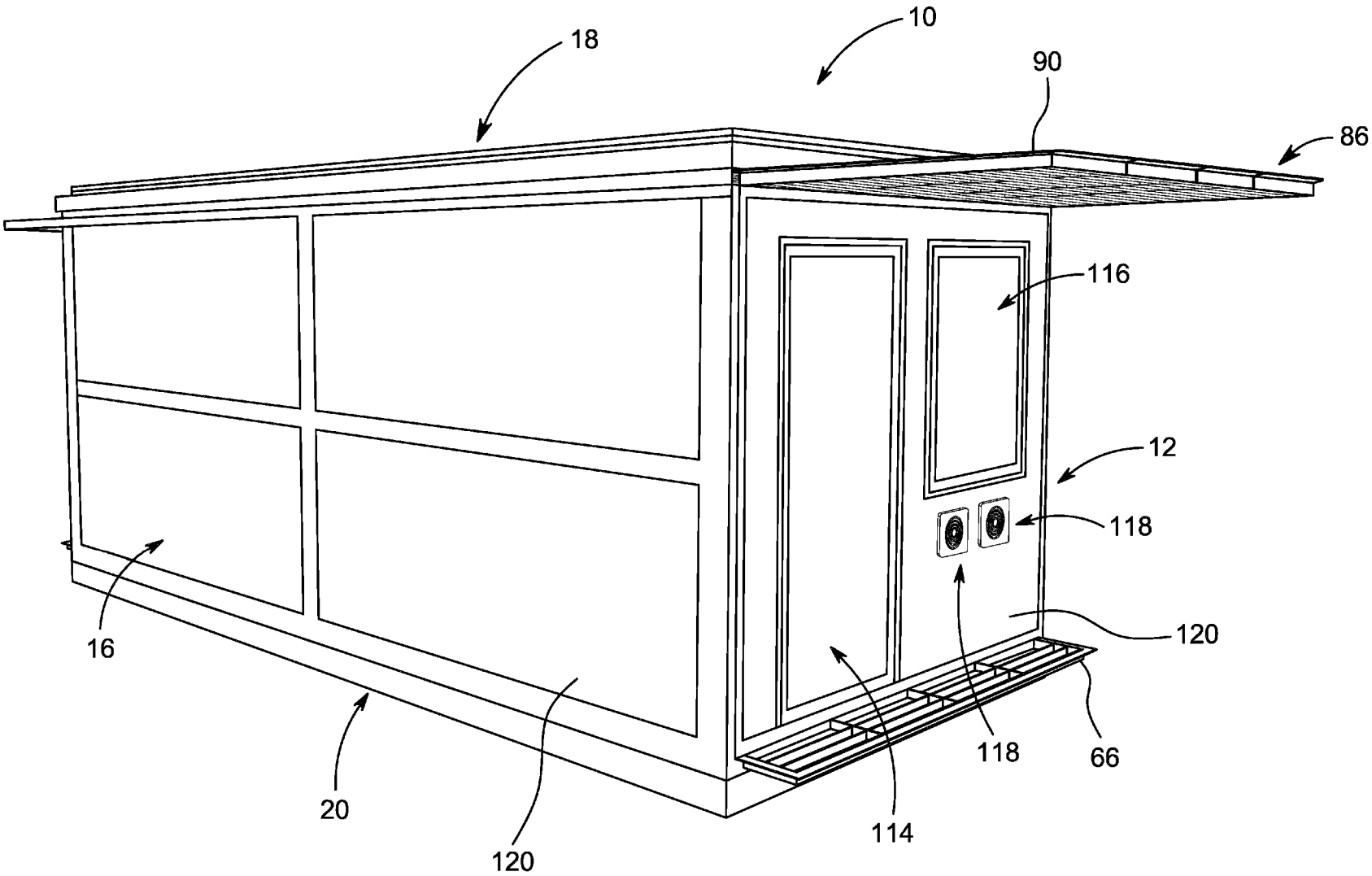
FIG. 1 shows a three-dimensional view of an embodiment of a collapsible dwelling, in accordance with one aspect of the invention.

In FIGS. 1 to 7, reference numeral 10 generally indicates an embodiment of a collapsible dwelling, in accordance with the invention. Reference to "dwelling" does not necessarily mean that the dwelling is only suited for housing human occupants. The dwelling could also be used for storage, for example, where it is necessary to control a climate within the dwelling, or for housing non-human occupants.

The dwelling 10 includes a front wall assembly 12, a rear wall assembly 14, opposed sidewall assemblies 16 a roof assembly 18 and a floor assembly 20.

The wall assemblies 12, 14, 16 are collapsible to be received between the floor assembly 20 and the roof assembly 18. The wall assemblies 12, 14, 16 are collapsible so that the wall assemblies 12, 14, 16 remain within a span or area between the floor assembly 20 and the roof assembly 18. In this example, the sidewall assemblies 16 are configured to collapse concertina-fashion, while the front and rear wall assemblies 12, 14 can be detached from the sidewall assemblies 16 and folded inwardly to overlie the floor assembly 20. It will thus be appreciated that a width of the front and rear wall assemblies 12, 14 is selected so that the front and rear wall assemblies 12, 14 can pivot or fold downwardly with respect to the sidewalls 16 while the sidewalls 16 are still in their operative or erected condition. The sidewalls 16 can be secured to the front and rear wall assemblies 12, 14 in any suitable manner, not shown, such as by clips, bolts or screws. Furthermore, junctions between various components such as the sidewalls 16 and the front and rear wall assemblies 12, 14 can be insulated against the ingress of wind and/or heat/cold.

For example, the front and rear wall assemblies 12, 14 can fold inwardly into general alignment with each other in the direction of dotted arrows 19, (FIG. 5) to be positioned on the floor assembly 20. The floor assembly 20 defines two recesses 22 (see for example FIGS. 4 and 5). The recesses 22 are dimensioned each to receive an appliance, for example an air conditioning unit 60 (see FIG. 5, for example), that is mounted on a respective front and rear wall assembly 12, 14, when that wall assembly is in a collapsed configuration. It is to be appreciated that the floor assembly 20 could define one or more than two recesses 22 for receiving associated appliances. The appliances 60 could be electrical appliances or other forms of accessories or fittings for use in the dwelling. Thus, there is no need to remove the appliances 60 prior to folding the front and rear wall assemblies 12, 14 to overlie the floor assembly 20.

The wall assemblies 12, 14, 16 and the floor and roof assemblies 20, 18 are dimensioned so that the dwelling 10 is substantially rectangular when viewed from above. In particular, the assemblies are dimensioned so that the dwelling 10 is elongate and rectangular with the sidewall assemblies 16 defining major sides of the dwelling 10 and the front and rear wall assemblies 12, 14 defining minor sides of the dwelling 10. The wall assemblies 12, 14, 16 are configured to fold operatively inwardly with respect to the roof and floor assemblies 18, 20 so that the roof assembly 18 can collapse downwards towards the floor assembly 20.

The floor assembly 20 includes a floor support structure 24 and flooring 26 (FIG. 16, for example) arranged on the support structure 24. Each sidewall assembly 16 is pivotally connected, at a lower edge, to a respective side edge of the floor support structure 24. Lower hinge assemblies 28 are interposed between respective sidewall assemblies 16 and associated side edges of the floor support structure 24 to facilitate the pivotal connection. The lower hinge assemblies 28 can be offset hinges so that when the sidewall assemblies 16 are folded inwardly, the offset hinges can permit the accommodation of the front and rear wall assemblies 12, 14.

Figure 8:
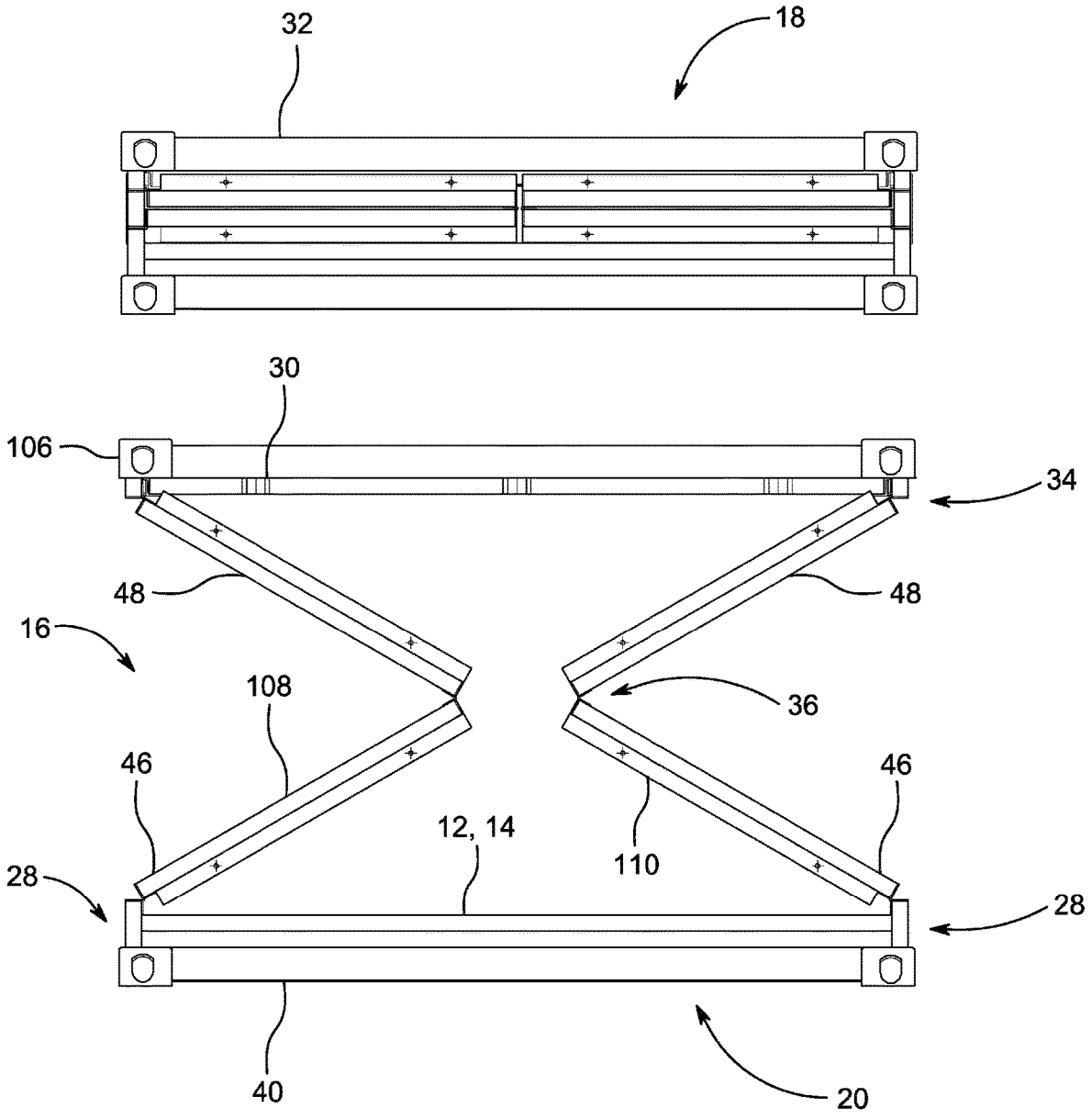
FIG. 8 shows an end view of the collapsible dwelling in a partially collapsed condition.
Figure 9:
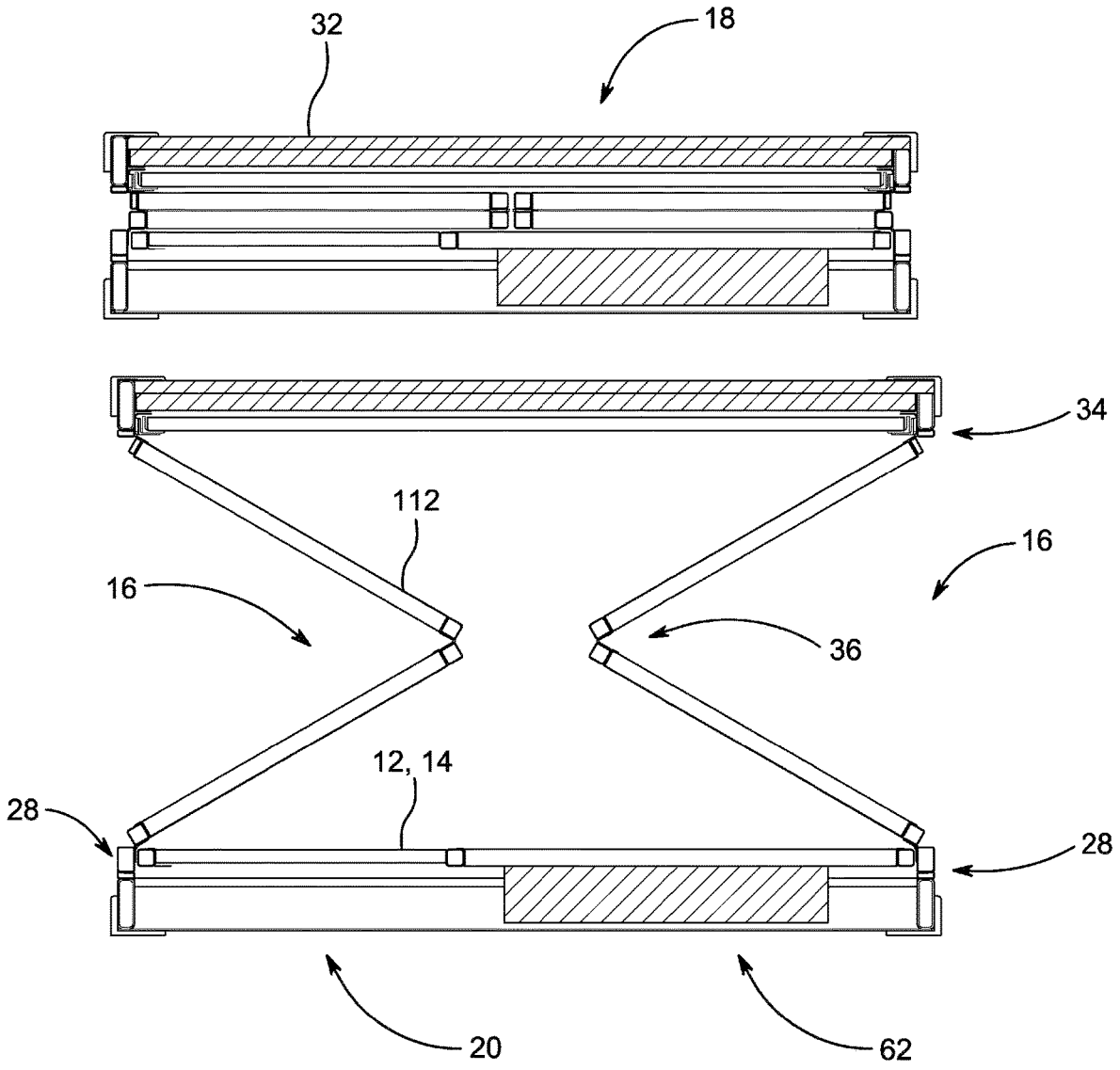
FIG. 9 shows a partly sectioned end view of the collapsible dwelling in a partially collapsed condition.

The roof assembly 18 includes a roof support structure 30 and roofing 32 arranged on the roof support structure 30. Each sidewall assembly 16 is pivotally connected, at an upper edge, to a respective side edge of the roof support structure 30. Upper hinge assemblies 34 (for example FIGS. 8 and 9) are interposed between respective sidewall assemblies 16 and associated side edges of the roof support structure 30 to facilitate the pivotal connection. Each sidewall assembly 16 includes a longitudinally extending intermediate hinge assembly 36 to allow the sidewall assemblies 16 to fold inwardly as the roof assembly 18 is lowered towards the floor assembly 20.

The front and rear wall assemblies 12, 14 are pivotally mounted to respective ends of the floor support structure 24 to pivot inwardly to accommodate the roof assembly 18 being lowered towards the floor assembly 20. In this example, the front and rear wall assemblies 12, 14 are pivotally mounted to respective front and rear edges of the floor support structure 24.

Figure 15:
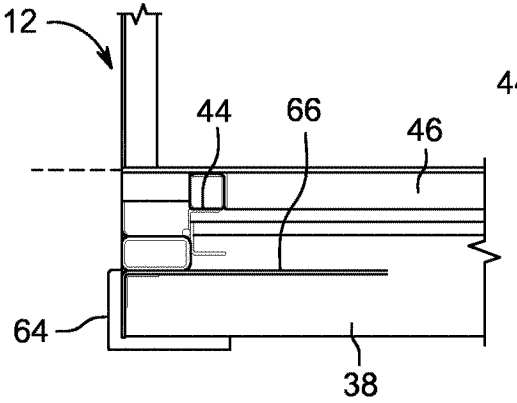
FIG. 15 shows a part sectional side view of part of the collapsible dwelling with the step member in a retracted condition.
Figure 14:
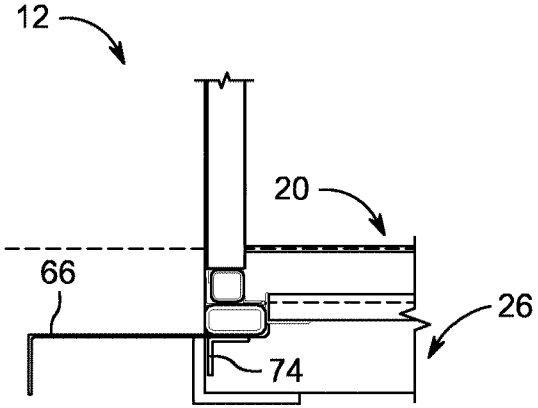
FIG. 14 shows a part sectional side view of part of the collapsible dwelling with the step member in an extended condition.
Figure 13:
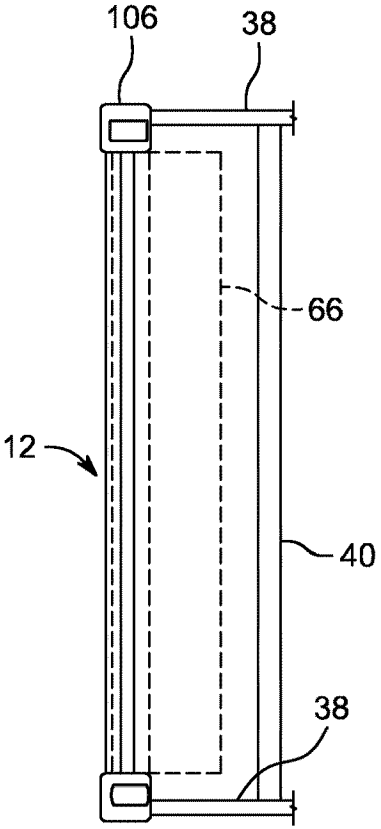
FIG. 13 shows a plan view, from above, of part of the collapsible dwelling showing a step member in a retracted condition.
Figure 22:
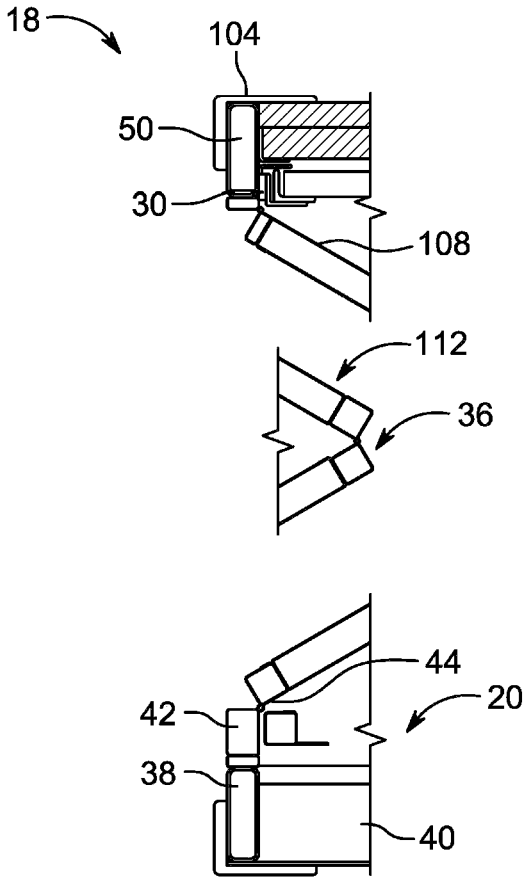
FIG. 22 shows a sectioned end view of part of the collapsible dwelling in a partially collapsed configuration.
Figure 23:
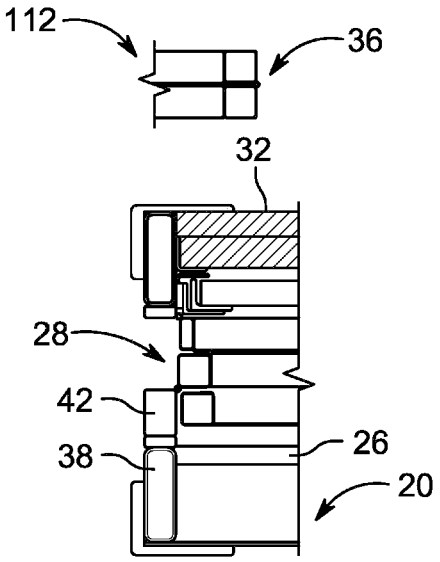
FIG. 23 shows a sectioned end view of the part of FIG. 22 in a collapsed configuration.

The floor support structure 24 includes two opposed side support beams 38 and a series of spaced joists 40 fastened to and extending between the beams 38. Each lower hinge assembly 28 is fastened to a respective side support beam 38. Each hinge assembly 28 includes a hinge block 42 (FIGS. 22 and 23, for example) that is mounted on the respective side support beam 38. One leaf of an offset hinge 44, for example as shown in FIG. 15, is mounted on the block 42. The offset hinge 44 is configured so that the front and rear wall assemblies 12, 14 can be accommodated when the sidewall assemblies 16 are collapsed. In other words, the offset hinge 44 inhibits interference between the sidewall assembly 16 and the front and rear wall assemblies 12, 14 by providing a level of displacement away from the floor assembly 20.

Figure 24:
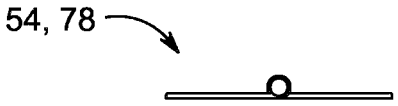
FIG. 24 shows a conventional hinge used in the collapsible dwelling.
Figure 25C:
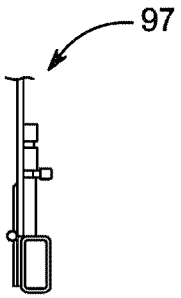
FIGS. 25 A to 25 E show various aspects of a bed and bed hanging support assembly for use in the collapsible container.
Figure 25B:
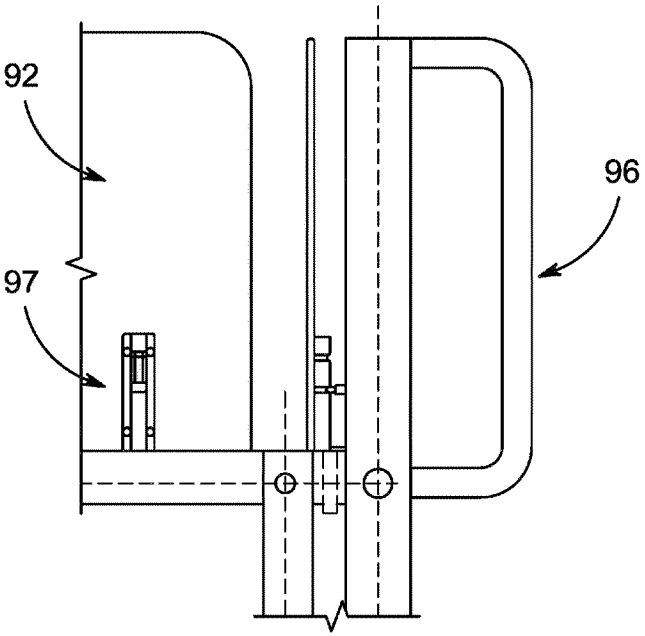
Figure 25E:
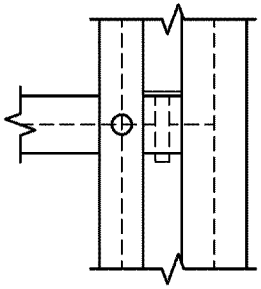
Figure 25A:
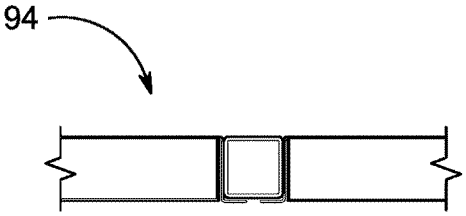
Figure 25D:
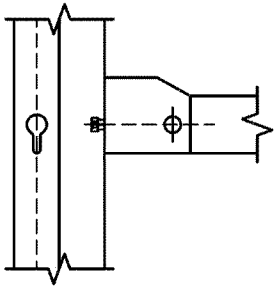

Each sidewall assembly 16 includes two wall members or panels, in the form of a lower panel 46 and an upper panel 48, that extend a length of the dwelling 10. A lower edge of the panel 46 or a framing member of the panel 46 is fastened to another leaf of the offset hinge 44 so that the panel 46 can pivot inwardly with respect to the support beam 38, with a clearance between the panel 46 and the flooring 26. As mentioned above, this clearance can accommodate the front and rear wall assemblies 12, 14 (see, for example, FIGS. 20 to 23). A lower edge of the upper panel 48 is pivotally connected to an upper edge of the lower panel 46 with the intermediate hinge assembly 36, along a length of the dwelling 10. The intermediate hinge assembly 36 can include a conventional hinge (for example as shown in FIG. 24) with one leaf fastened to the upper edge of the lower panel and the other leaf fastened to a lower edge of the upper panel. Thus, as the lower panels 46 pivot inwardly, the upper panels 48 can pivot outwardly with respect to the lower panels 48 so that the sidewall assemblies 16 can collapse downwardly.

The roof support structure includes two opposed roof support beams 50 that are aligned with the side support beams 38. Each upper hinge assembly 34 is fastened to a respective roof support beam 50. Each upper hinge assembly 34 includes hinge support blocks 52 (FIG. 28) that are mounted on the respective roof support beam 50 and upper edge of the panel 48. The leaves of a hinge 54 (FIG. 24) are fastened to respective blocks 52. This allows the upper panel 48 to pivot inwardly with respect to the roof support beam 50 with a clearance between the upper panel 48 and the roofing 32.

The way the sidewall assemblies 16 collapse can be seen in FIGS. 20 to 23. Each of the panels has been truncated for clarity.

Figure 16:
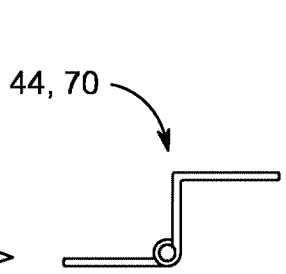
FIG. 16 shows an example of an offset hinge used in the collapsible dwelling

A crossbeam 68 (FIG. 26) is mounted on the side support beams 38 at each of the front and rear of the dwelling 10. Each of the front and rear wall assemblies 12, 14 includes a panel 56. The panels 56 are mounted on crossbeams 68 with a hinge assembly 58. The hinge assembly 58 includes an offset hinge 70 (FIG. 16). One leaf of the offset hinge 70 is fastened to the crossbeam 68. A hinge block 72 is fastened to the other leaf of the offset hinge 70. A lower edge of the panel 56 is fastened to the hinge block 72. This allows the panel 56 to pivot inwardly, with inward displacement, towards the flooring 26 and outwardly, as shown with an arrow 81, with outward displacement, into general alignment with an outer edge of the crossbeam 68 to form the front or rear side of the dwelling 10.

The hinge assembly 58 is configured to permit the panels 56 to be pivoted inwardly towards the flooring 26 to overlie the flooring. The offset hinges 70 are configured so that the sidewall assemblies can overlie the flooring 26 without interference. An example of such a collapsed configuration can be seen in FIG. 17.

An appliance or accessory 60 can be mounted internally on one or both panels 56 of the front and rear wall assemblies 12, 14. The appliance 60 in this example is an air conditioning unit. However, other forms of appliance are also envisaged. The appliance 60 extends into a dwelling space within the dwelling 10. In this case, the air conditioning unit can be a low-level packaged thermal air-conditioner (PTAC) and heat pump. The PTAC can be a twin duct unit. Such air-conditioners do not require an external condenser. An example of a suitable air conditioning unit is one within the Powrmatic Vision (trade mark) range. The flooring 26 defines suitable recesses 62 between consecutive joists 40. The recesses 62 and the air conditioning units 60 are positioned so that the recesses 62 accommodate a portion of the respective units 60 that project from the panels 56. Thus, the offset hinges 70 can be configured so that the appliance 60 is appropriately positioned when the front and/or rear wall assemblies 12, 14 are folded down. For example, the offset hinges 70 can be configured so that the appliance 60 clears surfaces that define the recess 62.

Figure 26:
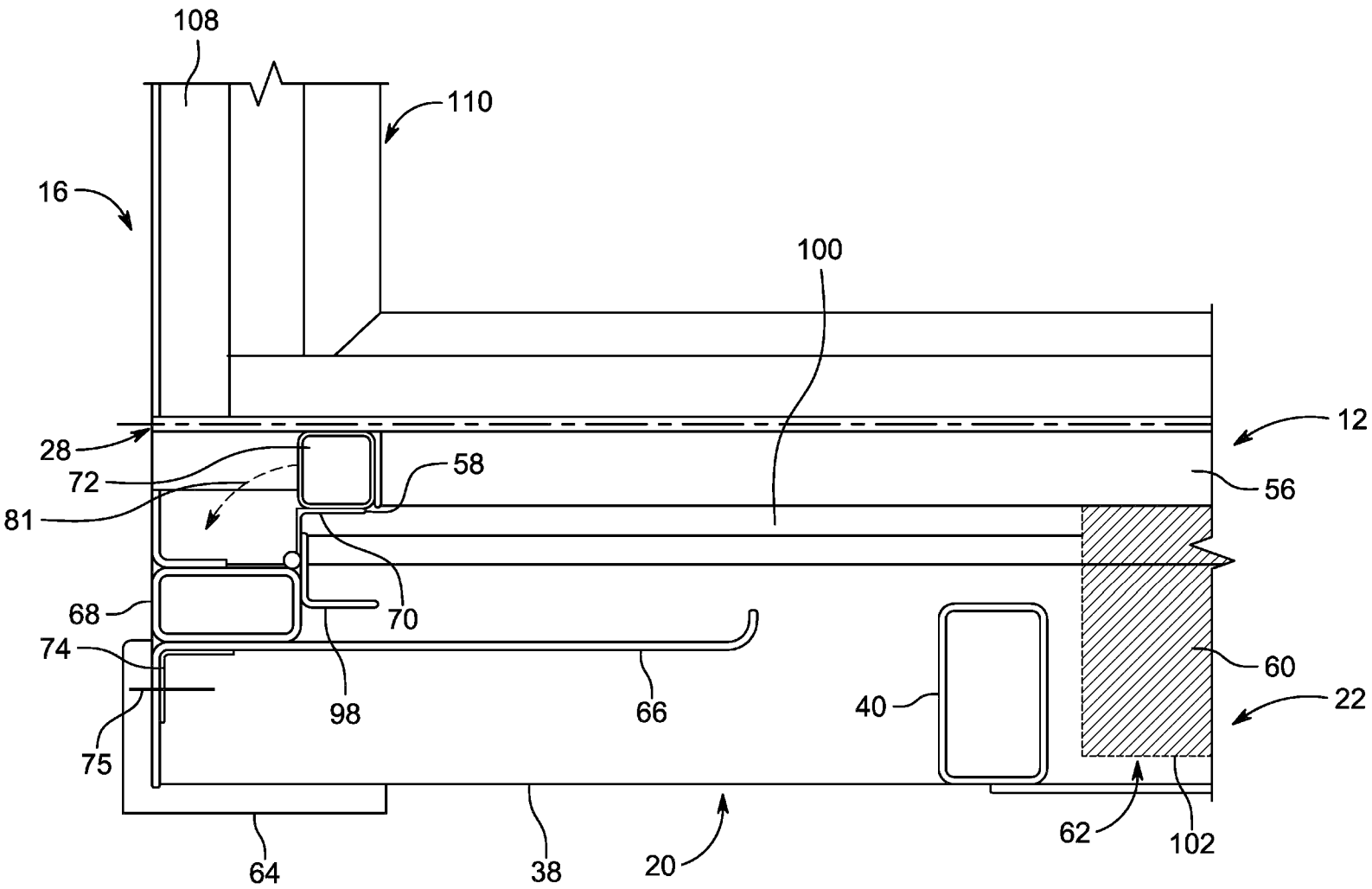
FIG. 26 shows a sectional end view of a lower corner assembly of the collapsible dwelling.

A corner fitting 64 is arranged on each corner of the floor assembly 20. For example, the corner fittings 64 are mounted on the side support beams 38, for example as can be seen in FIG. 26. The corner fittings 64 have a right-angled profile to accommodate the side support beams 38 to define feet for the dwelling 12.

A bracket 74 is mounted between the side support beams 38 below the crossbeam 68. A step member 66 is slidably retained between the bracket 74 and the crossbeam 68 so that it can be displaced outwardly to form a step for the dwelling 10 and inwardly into an inoperative position. The step member 66 can take various forms, for example, it can be in the form of grating or can carry a tread pattern for safety. A locking arrangement, for example a locking pin or fastener 75 can be releasably engaged with the step member 66 to lock the step member in the retracted condition, for example, for storage and transport.

Figure 28:
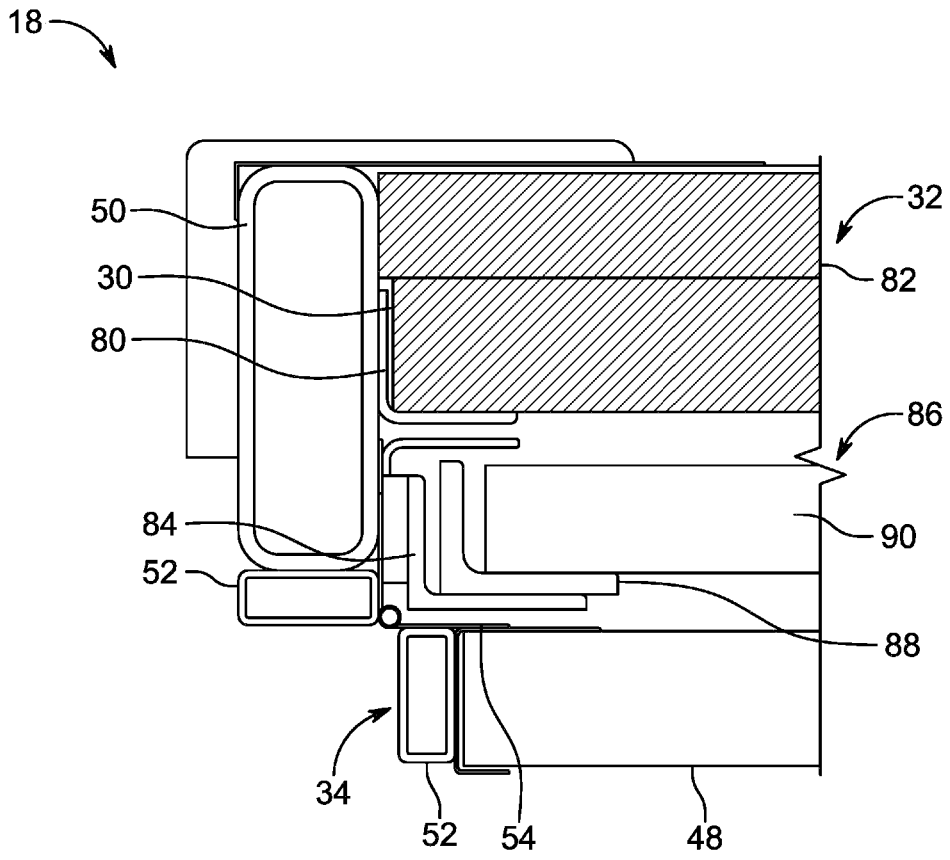
FIG. 28 shows a further detailed sectional end view of the upper corner assembly of the collapsible dwelling.
Figure 29:
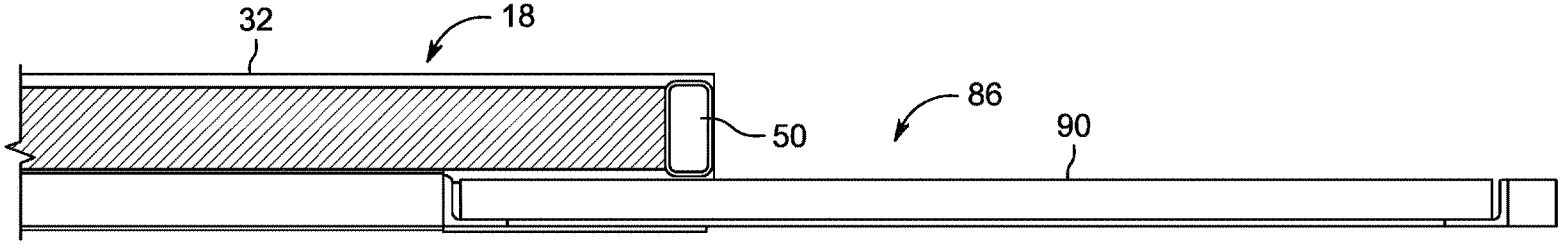
FIG. 29 shows a side sectional view of an awning assembly of the dwelling in an extracted condition.
Figure 30:
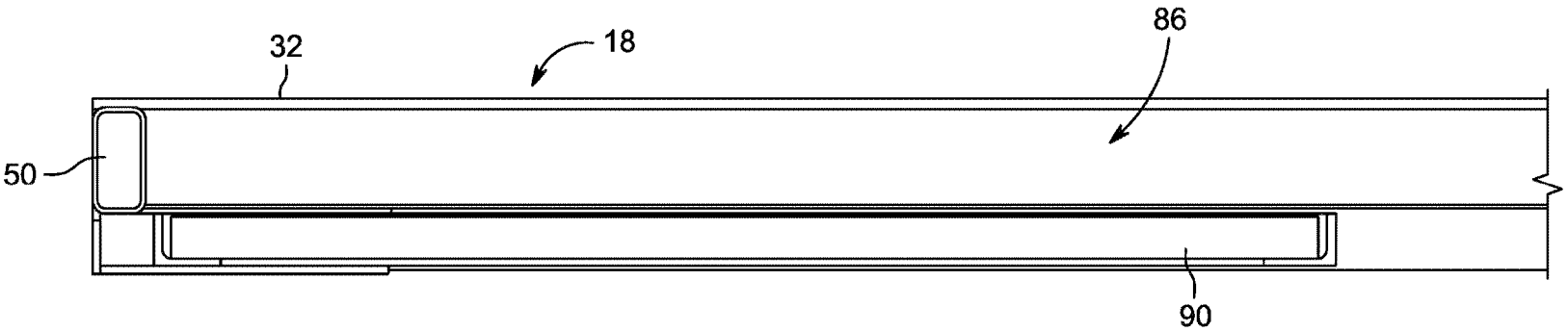
FIG. 30 shows a side sectional view of the awning assembly in a retracted condition.
Figure 31:
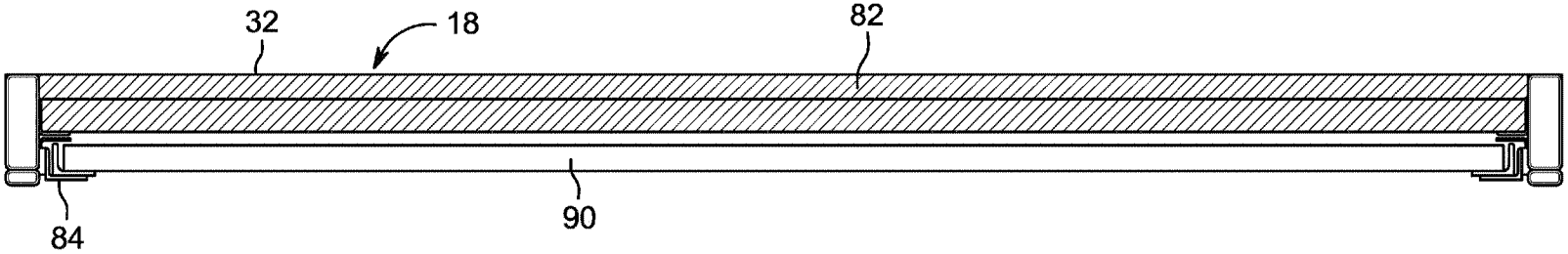
FIG. 31 shows an end view of the awning assembly.

Each upper hinge assembly 34 includes the hinge blocks 52 mounted on the roof support beam 50 and the upper panel 48 (FIG. 28). The leaves of the hinge 54 are fastened to the respective hinge blocks 52. Thus, the panel 48 can pivot into an operative position in which it is generally aligned with the roof support beam 50 and an inoperative position (FIG. 28) in which it is generally aligned with the roofing 32.

The roof support structure 30 includes roofing support brackets 80 mounted on inner sides of the roof support beams 50. The brackets 80 are configured to support roofing panels 82 between the support beams 50 to define the roofing 32.

Opposed awning support brackets 84 (one of which is shown in FIG. 28) are also mounted on opposed inner sides of respective roof support beams 50. A retractable awning assembly 86 is mounted on the support brackets 84. The awning assembly 86 includes opposed runners 88 mounted on the support brackets 84. An awning panel or platform 90 is mounted on the runners 88 so that it can slide along the runners 88 between an extracted position (see FIGS. 1, 2, 5, 12 and 30) and a retracted position (see FIGS. 4, 11, 29, 30 and 31).

Figure 10:
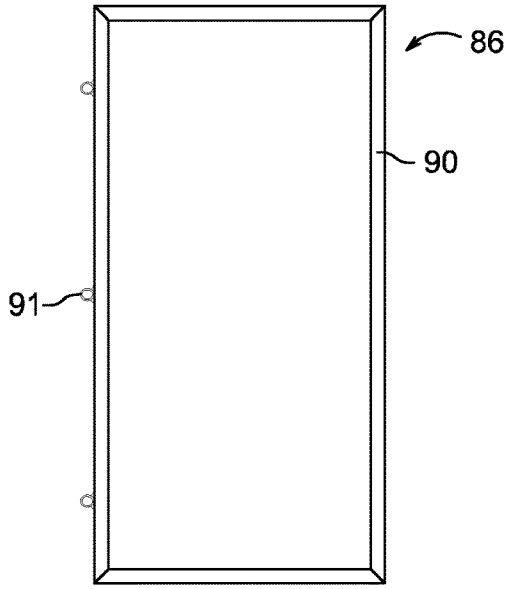
FIG. 10 shows a plan view, from above, of a retractable awning for the collapsible dwelling.
Figure 11:
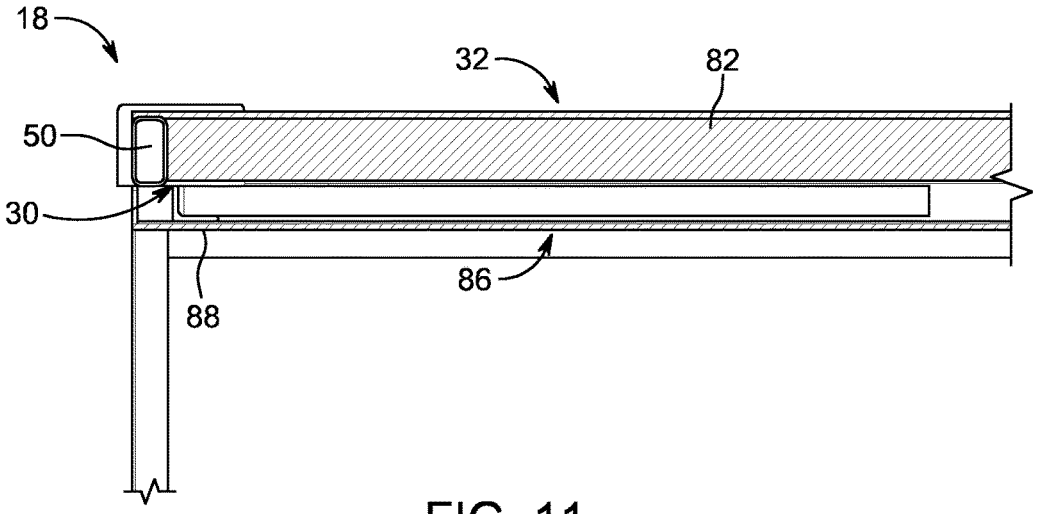
FIG. 11 shows a sectional side view of part of the collapsible dwelling showing the awning in a retracted condition.
Figure 12:
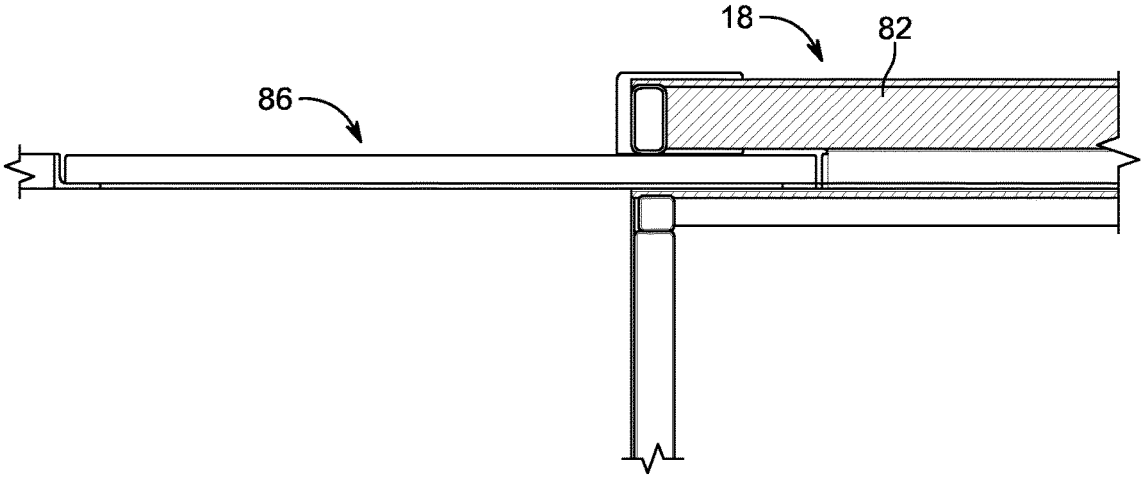
FIG. 12 shows a sectional side view of part of the collapsible dwelling showing the awning in an extended condition.

The awning assembly 86 can include awning supports 91 (FIG. 10) to support the awning panel 90 in the extracted position.

Figure 27:
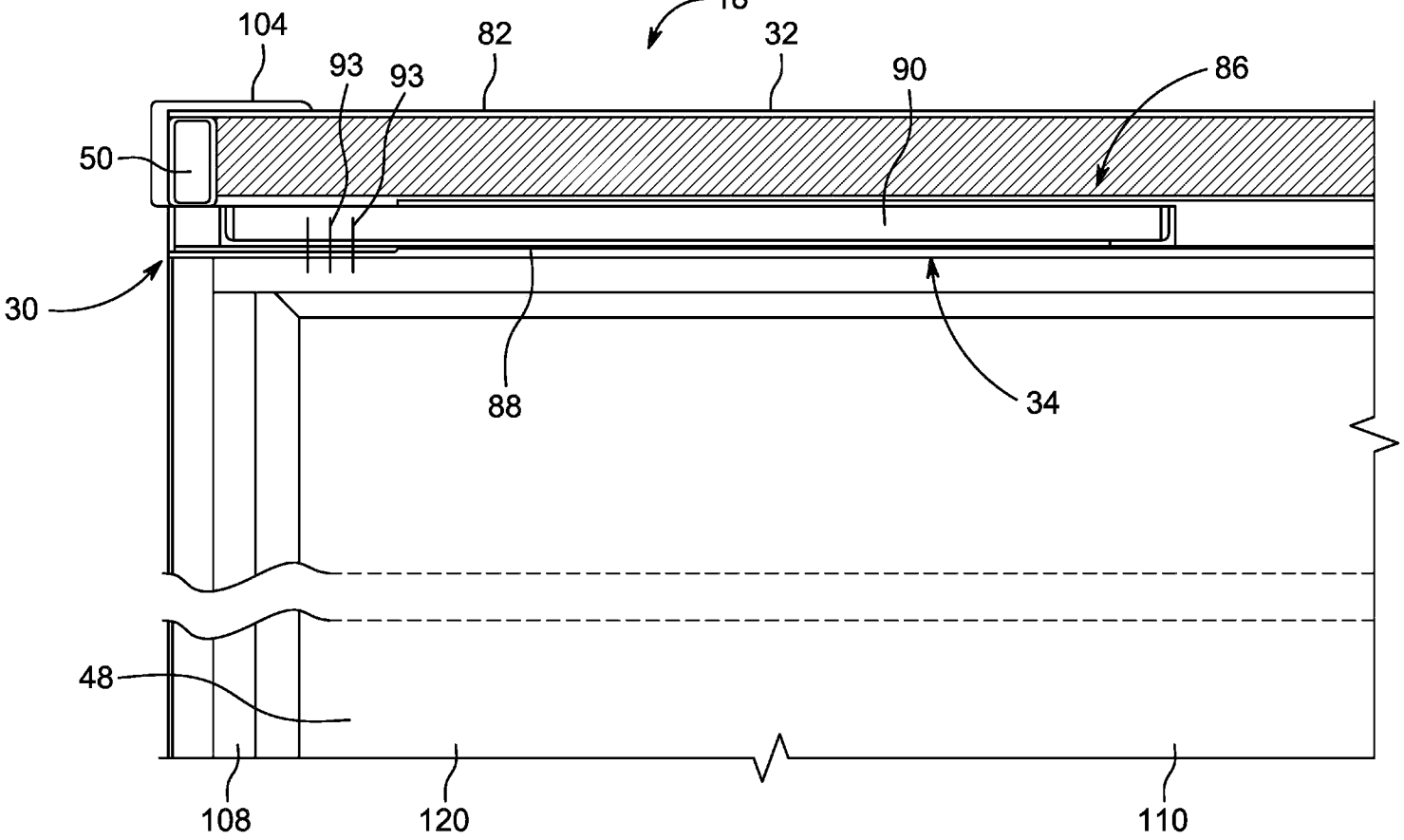
FIG. 27 shows a sectional end view of an upper corner assembly of the collapsible dwelling.

The awning assembly 86 includes a series of positioning bolts 93 (FIG. 27) that extend through the runners or runner 88 and into the awning panel 90 so that the awning panel 90 can be secured in a desired position, for example, in a retracted position for storage and transport.

The dwelling 10 can include various internal accessories for convenience. For example, as shown in FIGS. 25 A to E, the dwelling 10 can include a bed assembly 92. The bed assembly 92 includes a bed hanging support 94 that is arranged on one of the wall assemblies within the dwelling 10 and which is configured to permit a bed 96 to be hung, in a detachable manner, to one of the wall assemblies with a locking arrangement 97, such as a slide bolt latch that is fastened to the wall assembly with a bolt that can engage the bed 96. In operation, the bed 96 is positioned vertically, as opposed to its usual horizontal orientation. The slide bolt latch 98 can then be used to engage the bed 96 to retain the bed in that vertical orientation, in a space-saving manner. The bed 96 could be dimensioned so that it can remain within the dwelling 10 when the dwelling 10 is collapsed. Alternatively, the bed 96 can be removed before the dwelling is collapsed. A similar system could be used with other articles of furniture, fittings or appliances. Thus, in use, and occupant of the dwelling 10 can, optionally, free up space within the dwelling 10, for example, during the day when the bed assembly 92 is not required.

The flooring 26 includes opposed floor support brackets 98 (FIG. 26). The floor support brackets 98 support a structural floor member, such as a floor panel 100. The recesses 22 are defined by receptacles 102 having walls of expanded mesh. Thus, the appliance 60 can effectively be enclosed within a customised housing when the dwelling 10 is in the collapsed configuration. The floor panel 100 is shaped to accommodate the receptacles 102 that extend between the joists 40. The expanded mesh can be of metal and can be of a suitable strength to provide protection to the appliance 60 when the dwelling 10 is collapsed. The expanded mesh also serves to ventilate the receptacle 102 so that moisture does not build up within the appliance 60. The receptacles 102 can take other forms, depending on the shape of the appliance 60 and can be of suitable materials to protect the appliance 60.

Corner fittings 104 are mounted on the roof support beams 50 at each corner of the dwelling 10.

In some embodiments, handling assemblies 106 are mounted on each corner of the dwelling 10. The handling assemblies 106 are configured so that suitable cargo handling or similar machinery/apparatus can be used to lift and manipulate the dwelling 10. For example, the handling assemblies 106 can be similar to those used for shipping containers.

The front and rear wall assemblies 12, 14, the roof assembly 18 and the sidewall assemblies 16 are insulated. The panels 46, 48, 56 and 82 are of the type having an external cladding containing a core of insulation material. The external cladding can be a sheet of a plastics material, reinforced composite material or metal, such as aluminium or steel. The insulation material can be a thermal insulation material. The insulation material can also be of a fire-retardant material. The core of the panels can be of Polyisocyanurate fire-retardant material.

Figure 4:
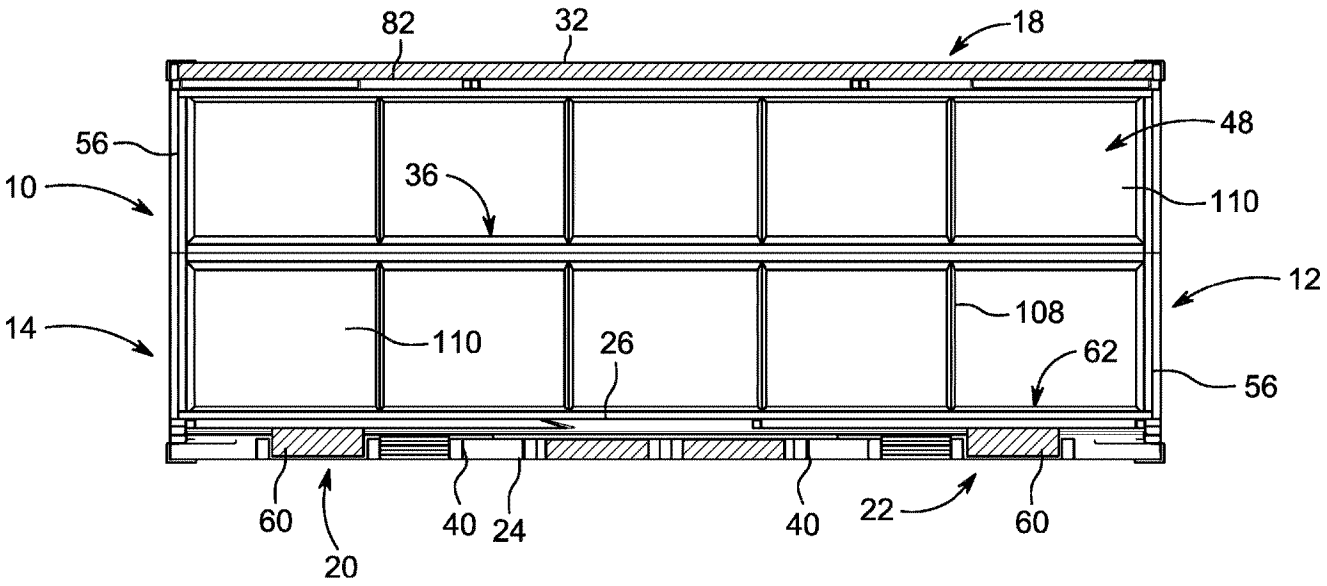
FIG. 4 shows a side sectioned view of the collapsible dwelling.
Figure 5:
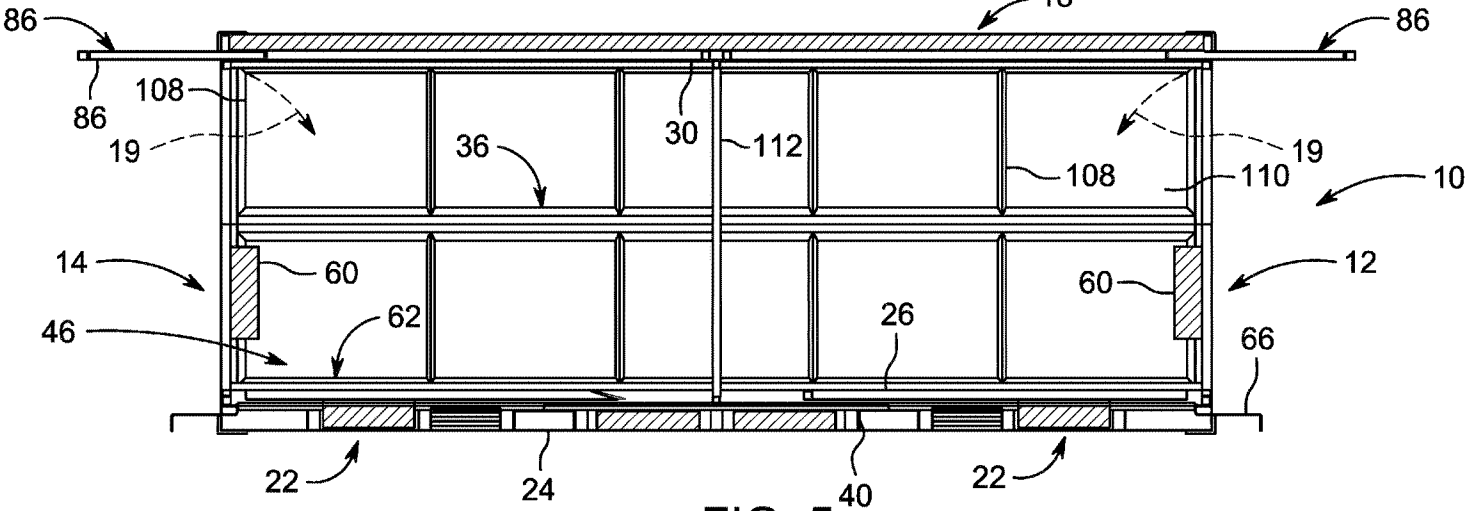
FIG. 5 shows a further side sectioned view of the collapsible dwelling.
Figure 6:
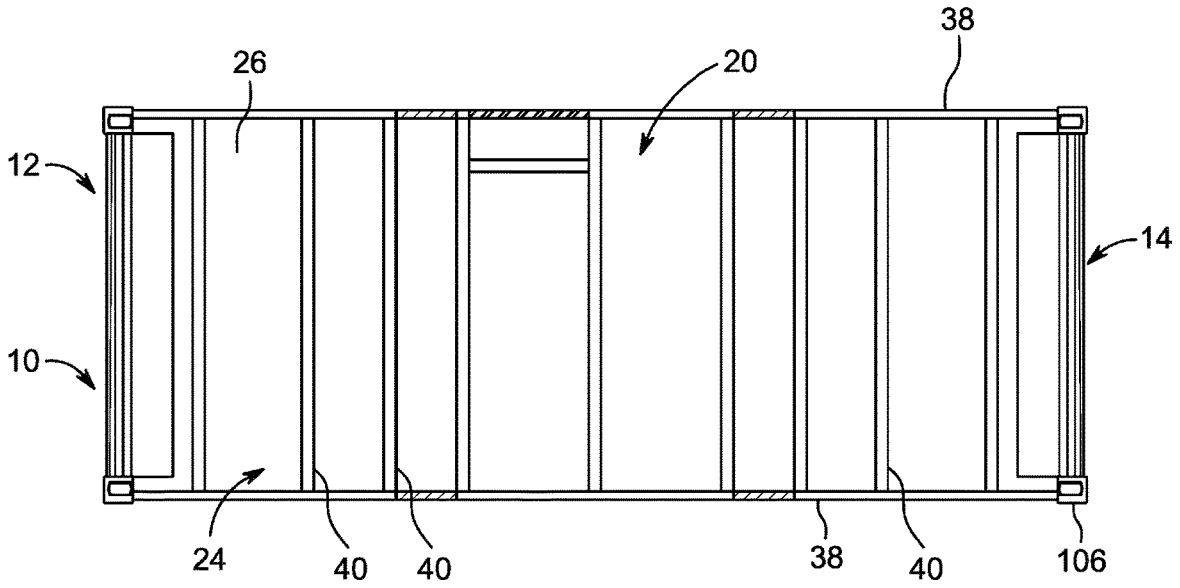
FIG. 6 shows a bottom plan view of the collapsible dwelling.
Figure 7:
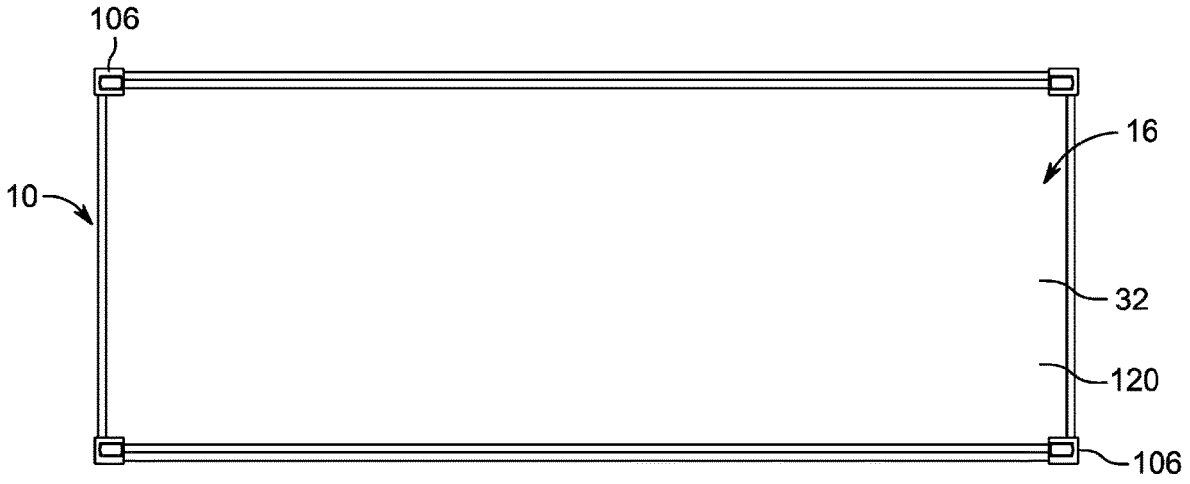
FIG. 7 shows a top plan view of the collapsible dwelling.

FIGS. 4 and 5 show further detail of the sidewall assemblies 16. Each sidewall assembly includes a frame assembly having a number of frames 108 into which panel modules 110 are mounted. Each of the panel modules 110 can be the same as the panels described above. As can be seen in FIG. 5, each sidewall 16 has a central support or spar 112 that extends between the side support beam 38 and the roof support beam 50. The spar 112 is hinged so that it can fold together with the sidewall assembly 16, in the manner described above.

Figure 2:
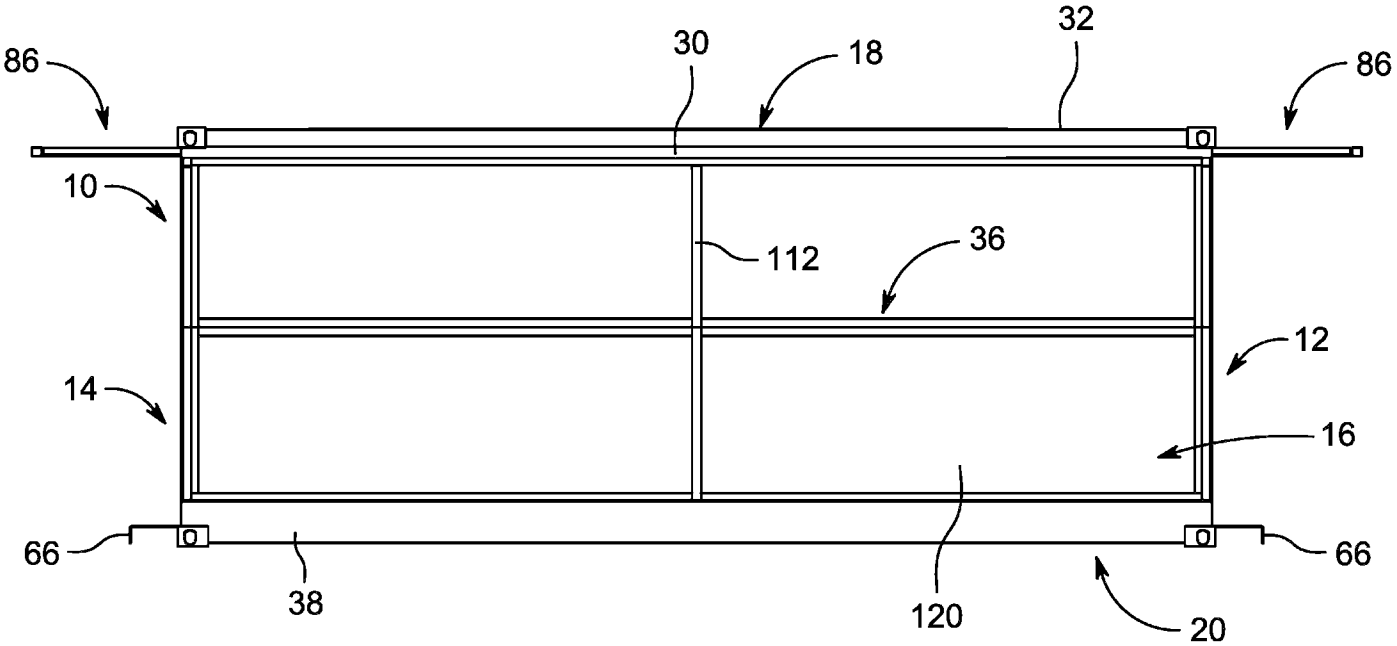
FIG. 2 shows a side view of the collapsible dwelling, with awnings and steps in extended conditions.
Figure 3:
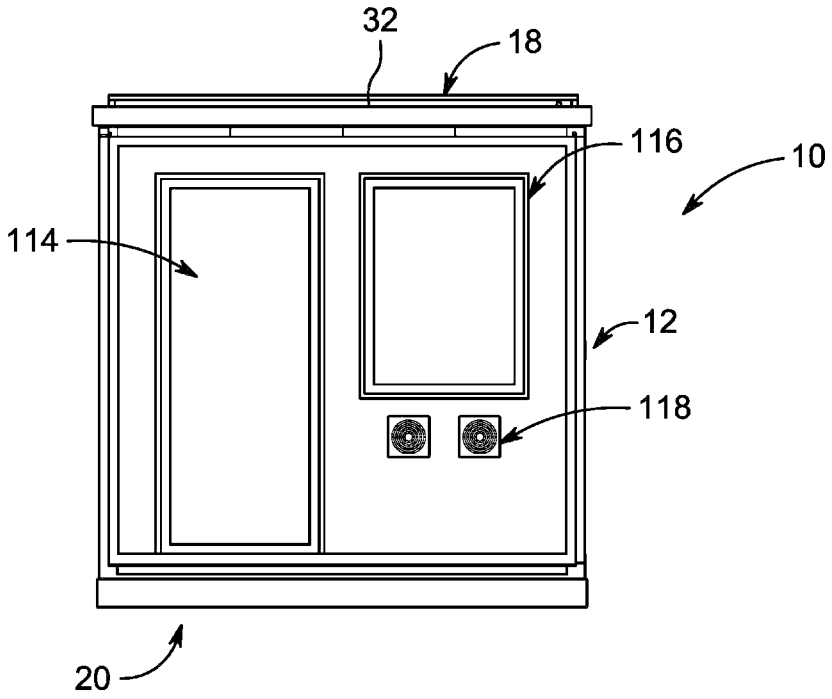
FIG. 3 shows a front-end view of the collapsible dwelling.

As can be seen in FIG. 2, for example, the exterior of the frames 108 and panel modules 110 is covered by a suitable weather resistant coating or flashing 120.

The various hinge assemblies described herein are configured so that, when the dwelling 10 is folded out into its operative or erected configuration, the panel modules 110 can engage each other in a substantially sealed manner, sufficient to inhibit ingress of wind and to facilitate thermal insulation of the dwelling 10.

Figure 17:
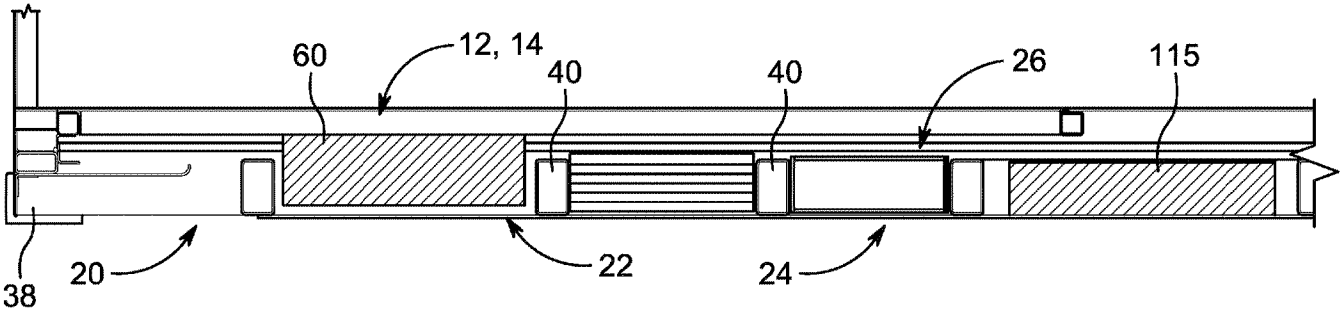
FIG. 17 shows a schematic side sectional view of the collapsible dwelling with one of the front and rear wall assemblies in a collapsed condition.
Figure 18:
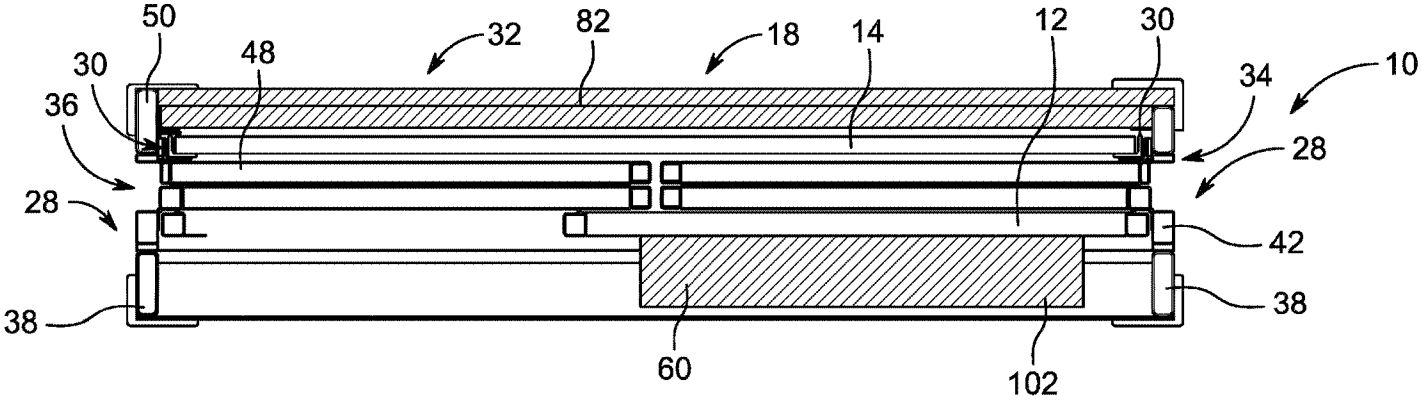
FIG. 18 shows a schematic end sectional view of the collapsible dwelling in a collapsed condition.
Figure 19:
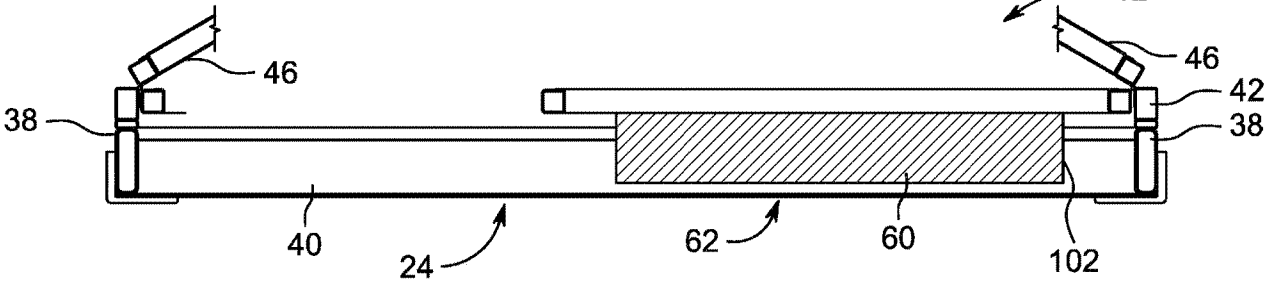
FIG. 19 shows a schematic end sectional view of the collapsible dwelling in a partially collapsed condition.
Figure 20:
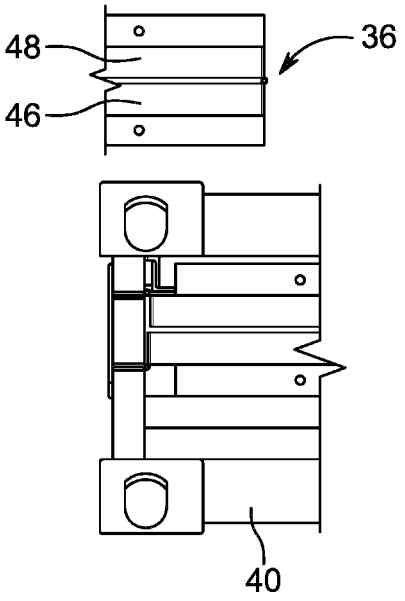
FIG. 20 shows an end view of part of the collapsible dwelling in a collapsed configuration.
Figure 21:
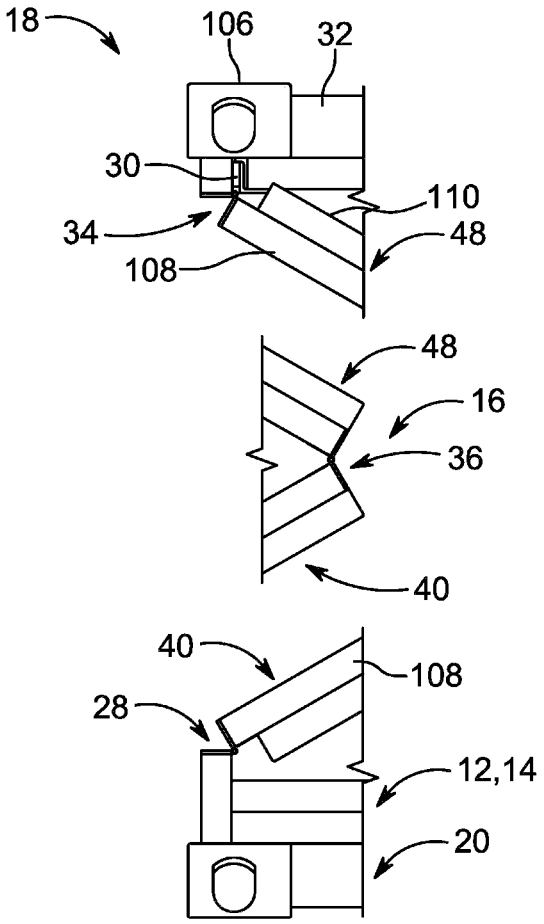
FIG. 21 shows the part in FIG. 20 in a partially collapsed configuration.

The floor assembly 20 houses an electrical supply assembly 115 (FIG. 17). This can include an electrical input point and a compartment for a rechargeable battery. This can be connected to the appliances 60 to supply the units 60 with power. Thus, both the electrical supply assembly 115 and the appliances 60 form an integral part of the collapsible dwelling 10. It follows that no electrical work is required, apart from possibly charging the battery, in order for the dwelling 10 to be erected and operative.

A door assembly 114 is mounted in the front wall assembly 12. A window assembly 116 is also mounted in the front wall assembly 12. A further window assembly 116 and door assembly 114 can also be mounted in the rear wall assembly 14.

Extractor fans 118 can be mounted in either of the wall assemblies, for example, the front wall assembly 12. The extractor fans 118 can also be connected to the electrical supply assembly 115 to power the extractor fans 118

The use of collapsible structures for dwelling purposes is known. However, the comfort of occupants in such collapsible structures can be dependent on the availability of air-conditioning, associated with insulation. The dwelling 10 is particularly useful for maintaining a level of environmental comfort to occupants. Furthermore, the fact that the dwelling 10 can be collapsed allows it to be conveniently transported to areas or regions in which it might be required temporarily. The erection of the dwelling 10 is a simple unfolding process and requires no additional installation of appliances such as air conditioners. This can be done with suitable machinery to lift the roof assembly 18 while the sidewall assemblies 16 unfold because of that lifting or as a result of further manipulation. The various components of the dwelling 10 are relatively rigid so that, when the dwelling 10 is folded out into its erected configuration, the dwelling 10 has a level of rigidity suitable for protection of the occupants for extended periods of time. For example, the frames 108 can be of aluminium, steel, or the like. Further, the panel modules 110 can be of a material having a level of structural integrity suitable for a conventional permanent dwelling.

The provision of the recesses 22 allows the wall assemblies to carry suitable appliances such as air conditioning units, for example the air conditioning unit 60 described above, without the need to remove those air-conditioning units when the dwelling 10 is collapsed. It will be appreciated that the installation of air conditioning units after erection would result in a process that is time-consuming and resource-hungry.

It follows that the dwelling 10 can find application for events such as multi-day open-air concerts, seminars and other similar events. Furthermore, the dwelling 10 also has application in other environments such as those that might arise in refugee situations.

The appended claims are to be considered as incorporated into the above description.

Throughout this specification, reference to any advantages, promises, objects or the like should not be regarded as cumulative, composite and/or collective and should be regarded as preferable or desirable rather than stated as a warranty.

Throughout this specification, unless otherwise indicated, "comprise," "comprises," and "comprising," (and variants thereof) or related terms such as "includes" (and variants thereof)," are used inclusively rather than exclusively, so that a stated integer or group of integers may include one or more other non-stated integers or groups of integers.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

The term "and/or", e.g., "A and/or B" shall be understood to mean either "A and B" or "A or B" and shall be taken to provide explicit support for both meanings or for either meaning.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The invention claimed is:

1. A collapsible dwelling that includes:

a front wall assembly;

a rear wall assembly;

opposed sidewall assemblies;

a roof assembly;

a floor assembly including a floor support structure and flooring arranged on the support structure;

at least one receptacle in the floor support structure, the flooring being shaped to accommodate the at least one receptacle, the, or each, receptacle defining a recess; and at least one appliance mounted on at least one respective wall assembly;

wherein the wall assemblies are collapsible to be received between the floor assembly and the roof assembly, the, or each, appliance being receivable in the, or one respective, recess.

2. The collapsible dwelling as claimed in claim 1, in which the flooring includes a floor panel that is shaped to accommodate the, or each, receptacle.

3. The collapsible dwelling as claimed in claim 2, in which the floor support structure includes opposed side support beams and a series of spaced joists fastened to, and extending between, the side support beams, the, or each receptacle extending between the joists.

4. The collapsible dwelling as claimed in claim 1, in which the front and rear wall assemblies each include a panel that is mounted to the floor support structure with a hinge assembly so that the panel can pivot inwardly towards the flooring to overlie the flooring, the, or each respective, appliance being mounted on the panel.

5. The collapsible dwelling as claimed in claim 4, in which the hinge assembly includes an offset hinge so that the appliance clears surfaces that define the recess when the panel is pivoted inwardly towards the flooring.

6. The collapsible dwelling as claimed in claim 1, in which each side wall assembly includes a lower panel and an upper panel, the lower panel being hinged to the floor support structure at a lower edge of the lower panel, the upper panel being hinged to the roof assembly at an upper edge of the upper panel and the lower and upper panels of the side wall assembly being hinged to each other at respective upper and lower edges, so that the upper and lower panels can fold inwardly to accommodate movement of the roof assembly towards the floor assembly when the dwelling is collapsed.

7. The collapsible dwelling as claimed in claim 6, in which the roof assembly includes a roof support structure and roofing arranged on the roof support structure, with each upper panel of the side wall assembly being hinged to a respective side edge of the roof support structure, at the upper edge of the upper panel.

* * * * *